US009411265B2

(12) United States Patent
Izumi et al.

(10) Patent No.: US 9,411,265 B2
(45) Date of Patent: Aug. 9, 2016

(54) DEVELOPER CONVEYING MECHANISM, IMAGE FORMING APPARATUS

(71) Applicant: KYOCERA Document Solutions Inc., Osaka-shi, Osaka (JP)

(72) Inventors: Koji Izumi, Osaka (JP); Masaru Takagi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/834,271

(22) Filed: Aug. 24, 2015

(65) Prior Publication Data

US 2016/0062267 A1 Mar. 3, 2016

(30) Foreign Application Priority Data

Aug. 27, 2014 (JP) ..... 2014-173273

(51) Int. Cl.
*G03G 15/08* (2006.01)
*G03G 21/10* (2006.01)

(52) U.S. Cl.
CPC ..... *G03G 15/0865* (2013.01); *G03G 21/105* (2013.01); *G03G 15/0879* (2013.01); *G03G 2215/0132* (2013.01)

(58) Field of Classification Search
CPC . G03G 21/10; G03G 21/105; G03G 15/0865; G03G 15/0877
USPC ..... 399/358
See application file for complete search history.

(56) References Cited

U.S. PATENT DOCUMENTS

| | | | | |
|---|---|---|---|---|
| 5,130,756 | A * | 7/1992 | Taniyama | G03G 21/105 399/358 X |
| 5,734,953 | A * | 3/1998 | Tatsumi | G03G 15/0865 399/119 |
| 6,266,511 | B1 * | 7/2001 | Murakami | G03G 21/105 399/358 X |
| 7,657,211 | B2 * | 2/2010 | Kawai | G03G 15/0877 399/358 X |
| 2012/0033997 | A1 * | 2/2012 | Fujita | G03G 15/0877 399/258 |
| 2013/0223873 | A1 * | 8/2013 | Manabe | G03G 21/105 399/358 X |
| 2015/0125196 | A1 * | 5/2015 | Mizutani | G03G 21/105 399/358 |

FOREIGN PATENT DOCUMENTS

JP 2010176005 A 8/2010

* cited by examiner

*Primary Examiner* — Sophia S Chen
(74) *Attorney, Agent, or Firm* — Alleman Hall McCoy Russell & Tuttle LLP

(57) ABSTRACT

A developer conveying mechanism includes a first lateral conveyance path forming portion and a second lateral conveyance path forming portion. The first lateral conveyance path forming portion includes a first conveyance member that is configured to convey developer in a first lateral direction. The second lateral conveyance path forming portion includes a second conveyance member that is configured to convey, in a second lateral direction, the developer that has fallen down from a lower opening of the first lateral conveyance path forming portion. The lower opening is formed such that its width expands from an upstream side to a downstream side in the first lateral direction.

7 Claims, 11 Drawing Sheets

DEVELOPER CONVEYING MECHANISM, IMAGE FORMING APPARATUS

INCORPORATION BY REFERENCE

This application is based upon and claims the benefit of priority from the corresponding Japanese Patent Application No. 2014-173273 filed on Aug. 27, 2014, the entire contents of which are incorporated herein by reference.

BACKGROUND

The present disclosure relates to a developer conveying mechanism and an image forming apparatus including the same.

In general, an electrophotographic image forming apparatus is provided with a developer conveying mechanism that conveys powdery developer by a conveyance member such as a screw-type conveyance member or a coil-type conveyance member. The developer conveying mechanism conveys developer that is to be supplied to a developing portion or developer (waste developer) that has been collected by a cleaning portion which removes residual developer from the surface of an image carrier.

In addition, the developer conveying mechanism may include a first lateral conveyance path, a longitudinal passage, and a second lateral conveyance path. The first lateral conveyance path is a passage that is formed to extend along a lateral direction, and includes, inside thereof, the conveyance member that conveys the developer in the lateral direction. An outlet from which the developer falls down is formed in the first lateral conveyance path. The longitudinal passage extends in a longitudinal direction, and the developer that has fallen down from the outlet passes through the longitudinal passage. The second lateral conveyance path is a passage that is formed to extend along a lateral direction, and includes, inside thereof, the conveyance member that further conveys, in the lateral direction, the developer that has passed through the longitudinal passage.

SUMMARY

A developer conveying mechanism according to an aspect of the present disclosure includes a first lateral conveyance path forming portion, a longitudinal passage forming portion, and a second lateral conveyance path forming portion. The first lateral conveyance path forming portion includes, inside thereof, a first conveyance member that is configured to convey the developer in the first lateral direction. The first lateral conveyance path forming portion forms a first lateral conveyance path for conveying developer in a first lateral direction. A lower opening is formed on the first lateral conveyance path forming portion as an outlet from which the developer falls down. The longitudinal passage forming portion forms a longitudinal passage of the developer that has fallen down from the lower opening. The second lateral conveyance path forming portion includes, inside thereof, a second conveyance member that is configured to convey, in the second lateral direction, the developer that has passed through the longitudinal passage. The second lateral conveyance path forming portion forms a second lateral conveyance path for conveying the developer in a second lateral direction. In the present developer conveying mechanism, the lower opening of the first lateral conveyance path forming portion is formed such that width thereof expands from an upstream side to a downstream side in the first lateral direction.

A developer conveying mechanism according to another aspect of the present disclosure includes the first lateral conveyance path forming portion, the longitudinal passage forming portion, and the second lateral conveyance path forming portion. In the present developer conveying mechanism, the lower opening of the first lateral conveyance path forming portion is formed in a range that extends, when viewed from above, from a predetermined position toward a downstream side in the first lateral direction. The predetermined position is a position that is, when viewed from above, closer to a center line of the second lateral conveyance path that extends along the second lateral direction, than an edge of an inlet of the longitudinal passage, the edge being in an upstream side in the first lateral direction.

An image forming apparatus according to a further aspect of the present disclosure includes the developer conveying mechanism according to the aspect of the present disclosure or the developer conveying mechanism according to the other aspect of the present disclosure.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the attached drawings. It should be noted that the following description is examples of specific embodiments of the present disclosure and should not limit the technical scope of the present disclosure.

First Embodiment

First, a description is given of an image forming apparatus 10 according to the first embodiment of the present disclosure with reference to FIGS. 1-6. The image forming apparatus 10 is an electrophotographic image forming apparatus.

[Configuration of Image Forming Apparatus 10]

Figure 1:
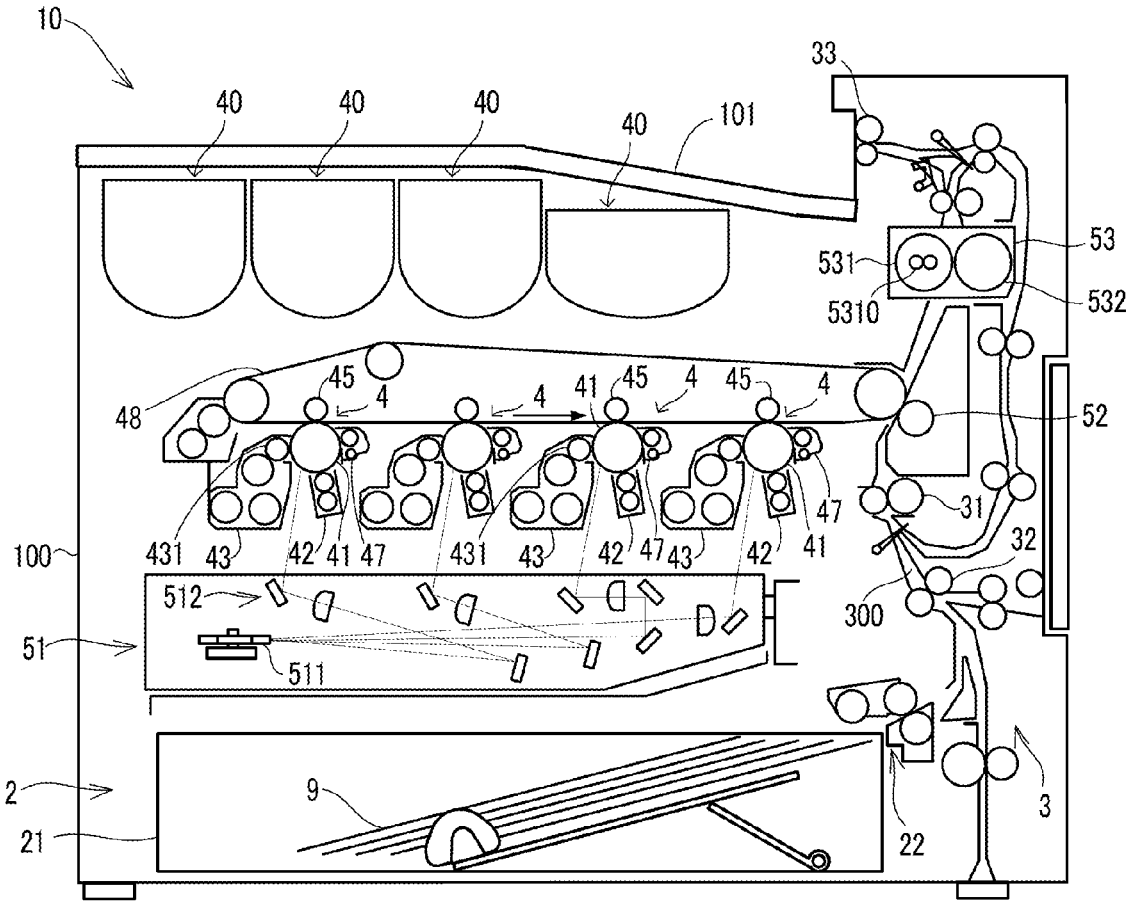
FIG. 1 is a configuration diagram of an image forming apparatus according to the first embodiment of the present disclosure.
Figure 2:
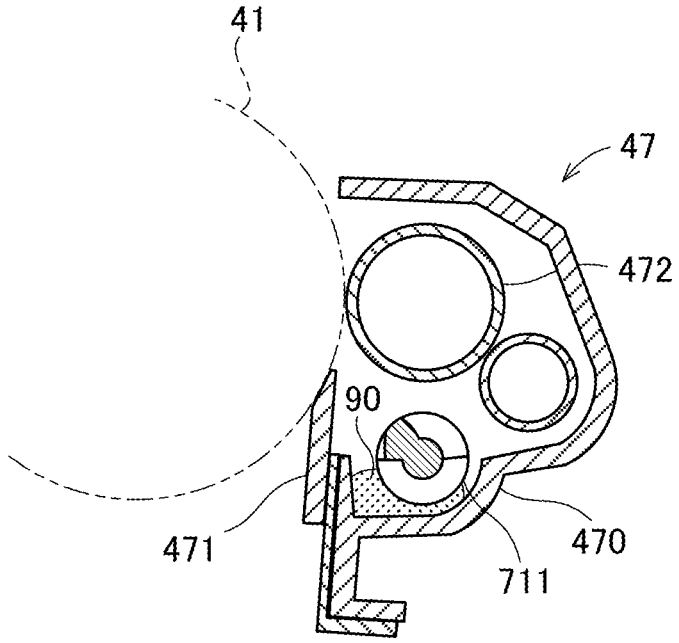
FIG. 2 is an approximate cross-sectional view of a primary cleaning portion provided in the image forming apparatus according to the first embodiment of the present disclosure.

In the example shown in FIG. 1, the image forming apparatus 10 is a tandem image forming apparatus and is a color printer. Other examples of the image forming apparatus 10 include a copier, a facsimile apparatus, and a multifunction peripheral having an image forming function.

The image forming apparatus 10 includes, in a housing 100, a sheet supply portion 2, a sheet conveying portion 3, a plurality of developer supply portions 40, a plurality of image forming portions 4, an optical scanning portion 51, a secondary transfer portion 52, a fixing portion 53, and an intermediate transfer belt 48.

The sheet supply portion 2 includes a sheet cassette 21 and a sheet feed portion 22, wherein the sheet cassette 21 can be attached to and detached from the housing 100, and the sheet feed portion 22 feeds a recording sheet 9 stored in the sheet cassette 21 to the image forming portion 4. It is noted that the recording sheet 9 is a sheet-like image formation medium such as a sheet of paper, a sheet of coated paper, a postcard, an envelope, or an OHP sheet.

The sheet feed portion 22 picks up the recording sheets 9 one by one from within the sheet cassette 21, and feeds the recording sheets 9 to a sheet conveyance path 300 of the sheet conveying portion 3.

The sheet conveying portion 3 includes a registration roller 31, a conveyance roller 32, and a discharge roller 33. The registration roller 31 and the conveyance roller 32 convey the recording sheet 9 in the sheet conveyance path 300. After an image is formed on the recording sheet 9 in the middle of the sheet conveyance path 300, the discharge roller 33 discharges the recording sheet 9 from a discharge port of the sheet conveyance path 300 onto a discharge tray 101.

The developer supply portions 40 and the image forming portions 4 are provided respectively in correspondence with the colors of the developer (toner). The colors of the developer are yellow, cyan, magenta and black. The developers of the respective colors are supplied from the developer supply portions 40 to the image forming portions 4. The developer supply portions 40 are, for example, attached to the housing 100 in a detachable manner.

Each of the developer supply portions 40 delivers the developer from a supply container storing the developer, to a corresponding developing portion 43 that is described below. The developer may be supplied directly to the developing portions 43 from the developer supply portions 40. Alternatively, the developer may be supplied to the developing portions 43 via an intermediate conveyance portion (not shown) from the developer supply portions 40.

The image forming portions 4 are disposed along the endless intermediate transfer belt 48 that rotates. The image forming portions 4 form a color toner image by overlaying images of different colors (toner images) on the surface of the rotating intermediate transfer belt 48.

Each image forming portion 4 includes a drum-like photoconductor 41, a charging portion 42, a developing portion 43, a primary transfer portion 45, and a primary cleaning portion 47. The photoconductor 41 is an example of the image carrier.

The intermediate transfer belt 48 is a belt-like member formed in the shape of an endless loop. The intermediate transfer belt 48 is rotated in the state where it is suspended between two rollers. In each image forming portion 4, the photoconductor 41 is rotated at a peripheral speed that corresponds to a peripheral speed (moving speed) of the intermediate transfer belt 48, and the charging portion 42 uniformly charges the surface of the photoconductor 41.

Furthermore, the optical scanning portion 51 including a laser light source (not shown), a polygon mirror 511, and an optical deflection instrument 512 scans laser light. With this operation, the optical scanning portion 51 writes an electrostatic latent image on the charged surface of the photoconductor 41.

The developing portion 43 includes a developing roller 431 that supplies developer to the photoconductor 41. The developing portion 43 develops the electrostatic latent image by supplying the developer to the photoconductor 41 by the developing roller 431. It is noted that the developing roller 431 may also be called a developing sleeve. In addition, the optical scanning portion 51 is generally called a laser scanning unit (LSU) or the like.

Furthermore, the primary transfer portions 45 transfer images (the developer) on the surfaces of the photoconductors 41 to the surface of the intermediate transfer belt 48. The secondary transfer portion 52 transfers an image (toner image) from the surface of the intermediate transfer belt 48 to the recording sheet 9 that is moving in the sheet conveyance path 300.

The fixing portion 53 nips the recording sheet 9 with the image formed thereon between a fixing roller 531 and a pressure roller 532 and feeds the sheet to a downstream step. The fixing roller 531 includes a heater 5310, such as a halogen heater, that is embedded therein. In this operation, the fixing portion 53 heats the developer on the recording sheet 9 and fixes the image to the recording sheet 9.

The primary cleaning portions 47 clean the surfaces of the photoconductors 41 by removing the developer 90 that remains on the surfaces of the photoconductors 41. In the example shown in FIG. 2, the primary cleaning portion 47 includes a cleaning blade 471, a cleaning roller 472, and a waste developer receiving portion 470, wherein the cleaning blade 471 and the cleaning roller 472 remove the developer 90 from the surface of the photoconductor 41. It is noted that in FIG. 2, the photoconductor 41 is drawn by an imaginary line (two-dot chain line).

The waste developer receiving portion 470 temporarily stores the developer 90 that has been removed from the surface of the photoconductor 41 by the cleaning blade 471 and the cleaning roller 472. The image forming apparatus 10 further includes a developer conveying mechanism 7 that conveys the developer 90 in the waste developer receiving portion 470 to a waste developer collection container 8.

[Developer Conveying Mechanism 7]

The following describes the developer conveying mechanism 7 with reference to FIGS. 3-6. The developer conveying mechanism 7 includes a first lateral conveyance path forming portion 71, a first conveyance member 711, a longitudinal passage forming portion 72, a second lateral conveyance path forming portion 73, and a second conveyance member 731.

The first lateral conveyance path forming portion 71 forms a conveyance path of the developer 90 that extends along a lateral direction. The first lateral conveyance path forming portion 71 is, for example, a cylindrical member supported along the lateral direction. The first conveyance member 711 conveys the developer 90 in the lateral direction by rotating in the conveyance path formed by the first lateral conveyance path forming portion 71.

It is noted that the lateral direction includes a horizontal direction (right sideways) and such directions that are slightly inclined with respect to the horizontal direction, for example, a direction (a diagonally horizontal direction) that forms an acute angle less than 45 degrees to the horizontal direction.

In the following description, the conveyance path of the developer 90 in the first lateral conveyance path forming portion 71 is referred to as a first lateral conveyance path 710. The first lateral conveyance path forming portion 71 includes, inside thereof, the first conveyance member 711 disposed in the first lateral conveyance path 710. In addition, the direction in which the first conveyance member 711 conveys the developer 90 is referred to as a first lateral direction R1.

The first conveyance member 711 is, for example, a conveyance screw that includes a rotation shaft portion 7111 and a blade portion 7112 that is formed in a spiral shape around the rotation shaft portion 7111. It is noted that the first conveyance member 711 may be a coil-like member.

The first lateral conveyance path 710 communicates with the inside of the waste developer receiving portion 470 of the primary cleaning portion 47. In addition, the first conveyance member 711 is continuously formed along the first lateral direction R1 from the inside of the waste developer receiving portion 470 to the first lateral conveyance path 710. In this case, the first lateral direction R1 is a direction parallel to the rotation center line of the photoconductor 41, and is a so-called main scanning direction.

Furthermore, a lower opening 712 as an outlet from which the developer 90 falls down, is formed in the vicinity of an end of the first lateral conveyance path forming portion 71 in the downstream side in the first lateral direction R1.

As a result, when the first conveyance member 711 rotates, the developer 90 is conveyed from the inside of the waste developer receiving portion 470 to the first lateral conveyance path 710, further conveyed in the first lateral conveyance path 710 in the first lateral direction R1, and then falls down from the lower opening 712.

The longitudinal passage forming portion 72 forms a passage that extends along a longitudinal direction so as to allow the developer 90 that has fallen down from the lower opening 712 to pass therethrough. The longitudinal passage forming portion 72 is, for example, a cylindrical member supported along a vertical direction. In the following description, the passage extending along a longitudinal direction formed by the longitudinal passage forming portion 72 is referred to as a longitudinal passage 720.

It is noted that the longitudinal direction includes the vertical direction and such directions that are slightly inclined with respect to the vertical direction, for example, a direction (a diagonally vertical direction) that forms an acute angle less than 45 degrees to the vertical direction.

In the following description, the conveyance path of the developer 90 formed by the second lateral conveyance path forming portion 73 is referred to as a second lateral conveyance path 730. The second lateral conveyance path forming portion 73 includes, inside thereof, the second conveyance member 731 disposed in the second lateral conveyance path 730. In addition, the direction in which the second conveyance member 731 conveys the developer 90 is referred to as a second lateral direction R2.

When viewed from above, the second lateral direction R2 intersects with the first lateral direction R1. That is, the first lateral conveyance path 710 and the second lateral conveyance path 730 are in a so-called twisted positional relation. In the present embodiment, when viewed from above, the second lateral direction R2 is perpendicular to the first lateral direction R1.

In addition, the center line of the second lateral conveyance path 730 that extends along the second lateral direction R2 is referred to as a second lateral conveyance path center line L1. When viewed from above, for example, the second lateral conveyance path center line L1 matches the rotation center line of the second conveyance member 731.

The developer 90 discharged from the lower opening 712 enters the longitudinal passage 720 from an inlet 721 of the longitudinal passage 720 that is provided at an upper end of the longitudinal passage forming portion 72, and further passes through the longitudinal passage 720 downward. In the example shown in FIG. 5, when viewed from above, the lower opening 712 is formed inside the rim of the inlet 721 of the longitudinal passage 720. For example, the lower opening 712 and the inlet 721 of the longitudinal passage 720 may have the same center in the second lateral direction R2. It is noted that, in FIG. 5, the first lateral conveyance path forming portion 71 is drawn by an imaginary line.

The second lateral conveyance path forming portion 73 is positioned below the longitudinal passage 720 and forms a conveyance path of the developer 90 that extends along a lateral direction. The second lateral conveyance path forming portion 73 is, for example, a cylindrical member supported along the lateral direction. The second conveyance member 731 is a member that conveys the developer 90 in the lateral direction by rotating in the second lateral conveyance path 730 formed by the second lateral conveyance path forming portion 73.

The second conveyance member 731 is, for example, a conveyance screw that includes a rotation shaft portion 7311 and a blade portion 7312 that is formed in a spiral shape around the rotation shaft portion 7311. It is noted that the second conveyance member 731 may be a coil-like member.

The image forming apparatus 10 further includes a driving source such as a motor (not shown). The first conveyance member 711 and the second conveyance member 731 are rotationally driven by, for example, the driving source and a gear mechanism that operates in conjunction with the movement of the driving source.

Figure 3:
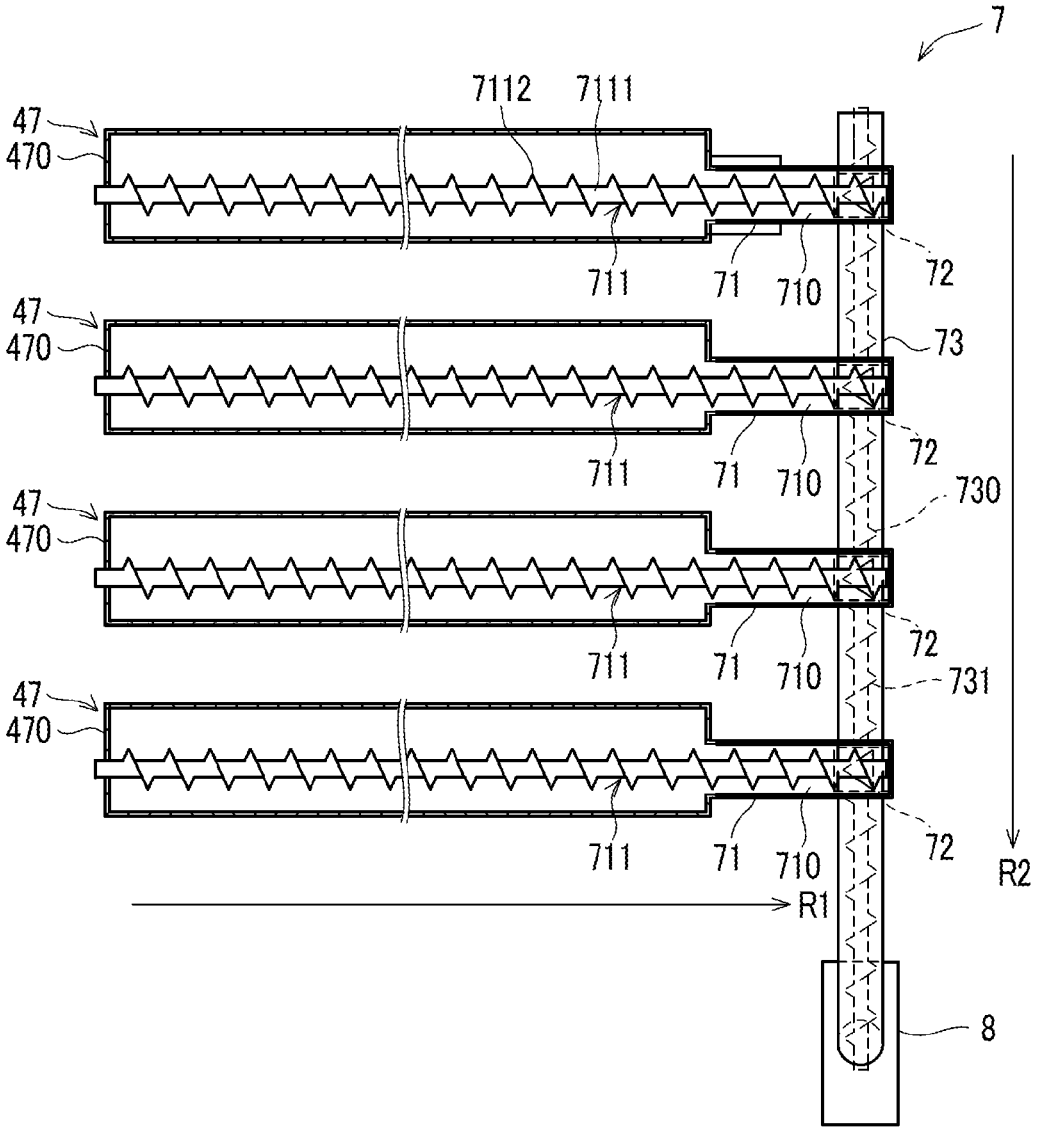
FIG. 3 is a partially cut plan view of a developer conveying mechanism provided in the image forming apparatus according to the first embodiment of the present disclosure.
Figure 4:
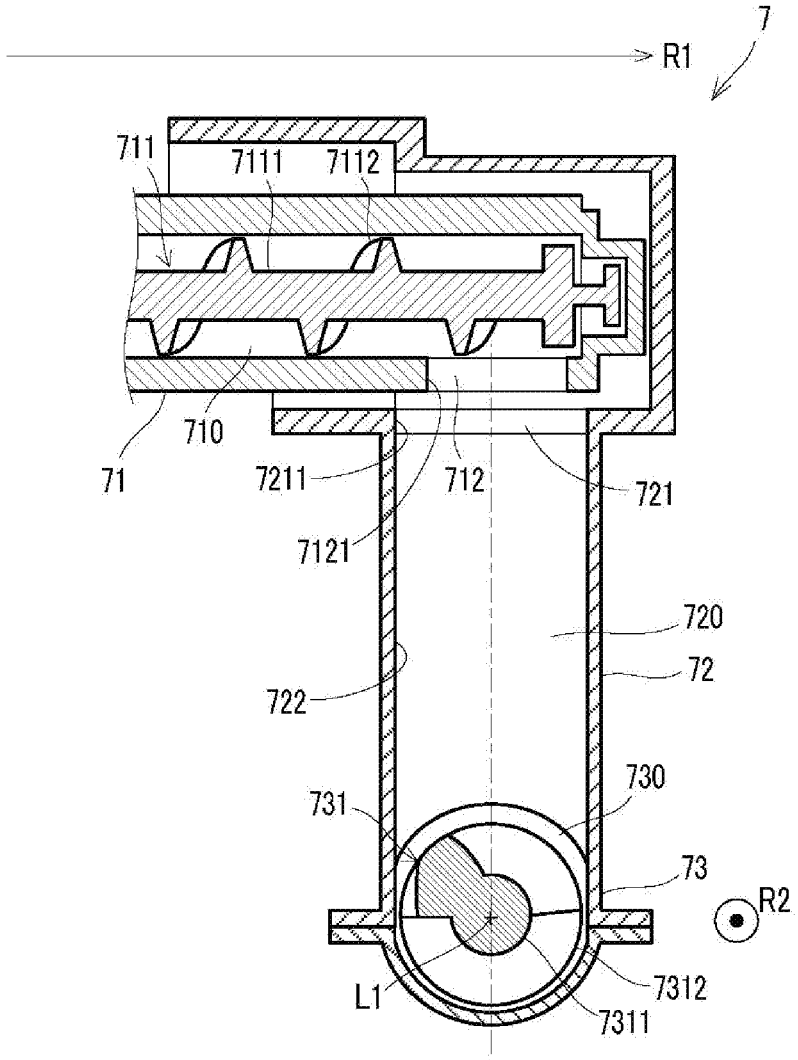
FIG. 4 is a vertical cross-sectional view of the developer conveying mechanism provided in the image forming apparatus according to the first embodiment of the present disclosure.

As shown in FIG. 3, the image forming apparatus 10 includes a plurality of first lateral conveyance path forming portions 71, and the same number of first conveyance members 711 and longitudinal passage forming portions 72. The first lateral conveyance path forming portions 71, first conveyance members 711, and longitudinal passage forming portions 72 are respectively provided in correspondence with the primary cleaning portions 47, namely, in correspondence with the colors of the developer 90.

On the other hand, the second lateral conveyance path forming portion 73 and the second conveyance member 731 are common to the plurality of first lateral conveyance path forming portions 71 and the plurality of longitudinal passage forming portions 72. The plurality of first lateral conveyance path forming portions 71 are arranged at intervals in the second lateral direction R2. Similarly, the plurality of longitudinal passage forming portions 72 are arranged at intervals in the second lateral direction R2.

The developer 90 that has fallen into the second lateral conveyance path 730 is conveyed in the second lateral conveyance path 730 in the second lateral direction R2 by the rotating second conveyance member 731. The developer 90 is then conveyed to the vicinity of an end of the second lateral conveyance path 730 in the downstream side in the second lateral direction R2, and falls into the waste developer collection container 8 from an opening formed in the lower side of the second lateral conveyance path forming portion 73. This allows the waste developer 90 of all colors to be collected in one waste developer collection container 8.

As described above, the first lateral conveyance path 710 and the second lateral conveyance path 730 are conveyance paths of waste developer that has been removed from the surface of the photoconductor 41 by the primary cleaning portion 47 that cleans the surface of the photoconductor 41.

Meanwhile, if the developer 90 discharged from the first lateral conveyance path 710 falls down in a state of deviating toward an inner wall surface 722 of the longitudinal passage 720, a conveyance failure of the developer 90 may occur.

For example, the developer 90 discharged from the first lateral conveyance path 710 may stick to and accumulate on the inner wall surface 722, and the longitudinal passage 720 may be clogged. In addition, the developer 90 that has passed through the longitudinal passage 720 may intensively accumulate on the peripheral of the outer edge of the second conveyance member 731 in the second lateral conveyance path 730. In that case, the efficiency of conveyance of the developer 90 by the second conveyance member 731 in the second lateral conveyance path 730 may be degraded.

On the other hand, the developer conveying mechanism 7 has a configuration for preventing such a conveyance failure from occurring. In the following, the configuration is described.

Figure 5:
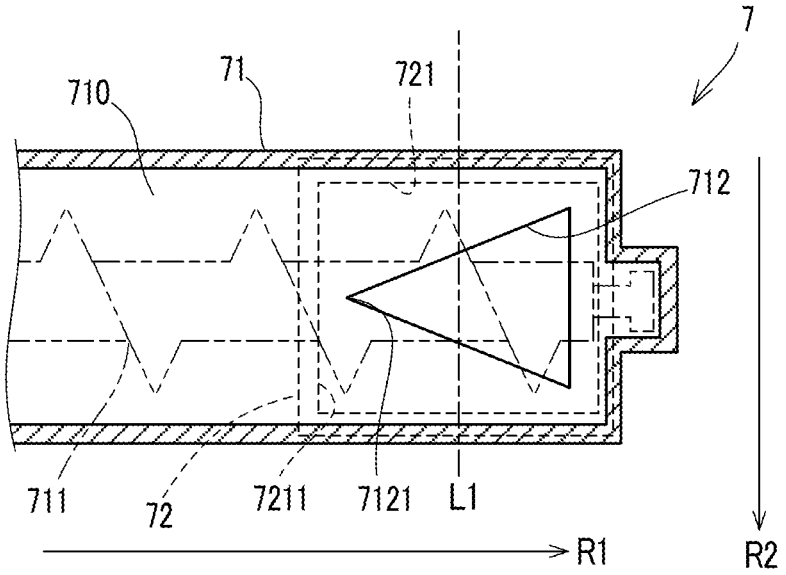
FIG. 5 is a cross-sectional plan view of a first lateral conveyance path forming portion of the developer conveying mechanism provided in the image forming apparatus according to the first embodiment of the present disclosure.

As shown in FIG. 5, the lower opening 712 of the first lateral conveyance path forming portion 71 is formed such that its width expands from the upstream side to the downstream side in the first lateral direction R1. In the example shown in FIG. 5, the lower opening 712 is formed in the shape of an isosceles triangle where the width gradually expands from an edge 7121 in the upstream side in the first lateral direction R1 along the pair of straight lines. The edge 7121 of the lower opening 712 in the upstream side in the first lateral direction R1 corresponds to a vertex of a vertical angle of the isosceles triangle.

In the example shown in FIG. 5, the lower opening 712 is formed such that its width gradually expands from the upstream side to the downstream side in the first lateral direction R1 in a range which, when viewed from above, extends from the edge 7121 of the lower opening 712 in the upstream side in the first lateral direction R1 to a position exceeding the second lateral conveyance path center line L1.

Furthermore, in the example shown in FIG. 5, the lower opening 712 is formed in a range that extends, when viewed from above, from a predetermined position toward the downstream side in the first lateral direction R1. The predetermined position (the position of the edge 7121) is a position that is, when viewed from above, between the second lateral conveyance path center line L1 and an edge 7211 of the inlet 721 of the longitudinal passage 720 in the upstream side in the first lateral direction R1. It is noted that the effect produced by forming the lower opening 712 in the above-described range is described in the fourth embodiment.

Figure 6:
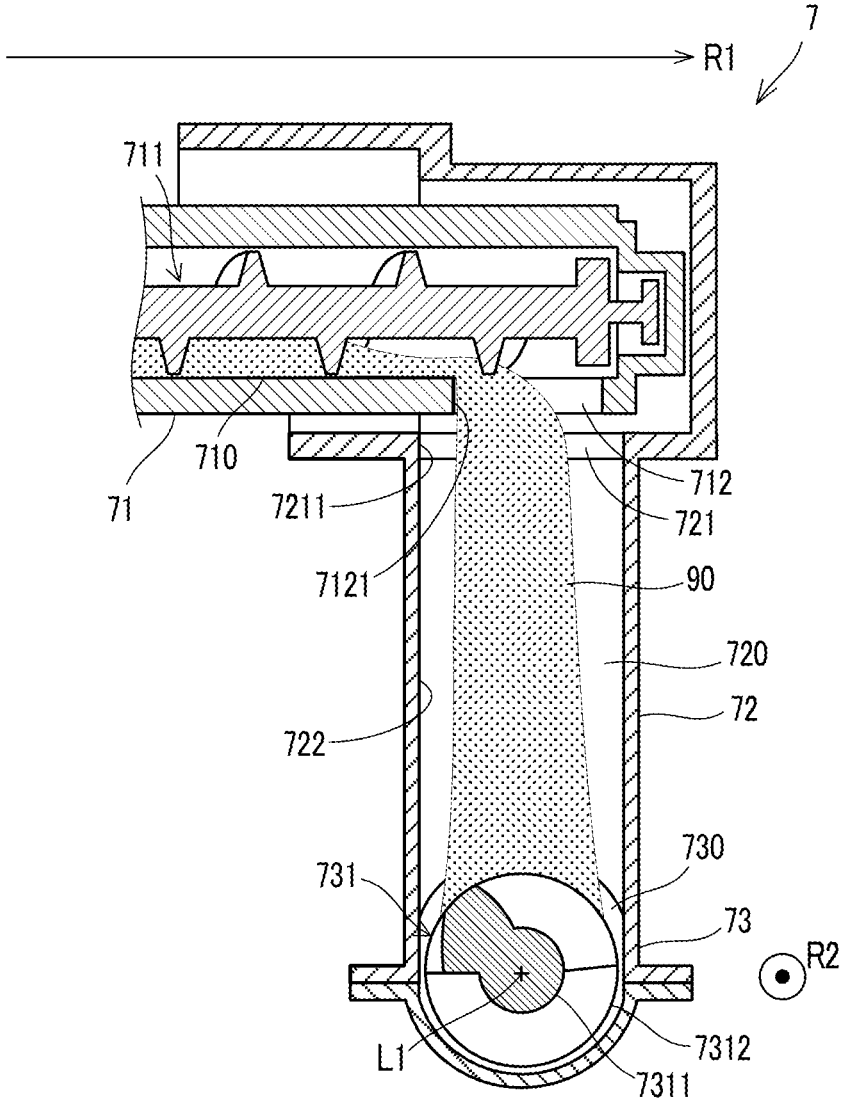
FIG. 6 is a vertical cross-sectional view of the developer conveying mechanism that is conveying the developer in the image forming apparatus according to the first embodiment of the present disclosure.

FIG. 6 is a vertical cross section of the developer conveying mechanism 7 that is conveying the developer 90. In the present embodiment, upon reaching the lower opening 712, the developer 90 falls down little by little as it advances with the width of the lower opening 712 gradually expanding.

With the above-described configuration, the developer 90 falls down in a state of dispersing in a relatively wide range that extends from a position in the upstream side in the first lateral direction R1 to a position in the downstream side, not in the state of deviating toward the inner wall surface 722 of the longitudinal passage 720. As a result, the developer 90 is difficult to stick to the inner wall surface 722 of the longitudinal passage 720. Furthermore, the configuration restricts the efficiency of conveyance of the developer 90 from being degraded due to the intensive accumulation of the developer 90 on the peripheral of the outer edge of the second conveyance member 731.

As understood from the above description, in the case where the developer 90 falls down from the first lateral conveyance paths 710 at an upper position to the second lateral conveyance path 730 at a lower position which both extend in the lateral direction, it is suitable to adopt the developer conveying mechanism 7 and the image forming apparatus 10 that includes the developer conveying mechanism 7. This makes it possible to prevent a conveyance failure of the developer 90 from occurring.

In addition, in the example shown in FIG. 5, when viewed from above, the lower opening 712 is formed inside the rim of the inlet 721 of the longitudinal passage 720. That is, when viewed from above, the rim of the lower opening 712 does not protrude outside of the rim of the inlet 721. This makes it possible to prevent the developer 90 from sticking to the inner wall surface 722 of the longitudinal passage 720 in a more reliable manner.

Second Embodiment, Third Embodiment

Figure 7:
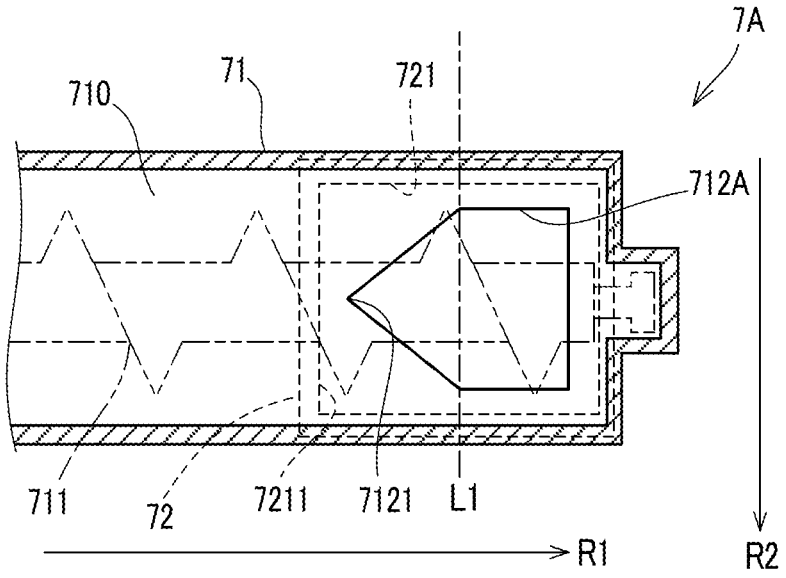
FIG. 7 is a cross-sectional plan view of the first lateral conveyance path forming portion of the developer conveying mechanism provided in the image forming apparatus according to the second embodiment of the present disclosure.
Figure 8:
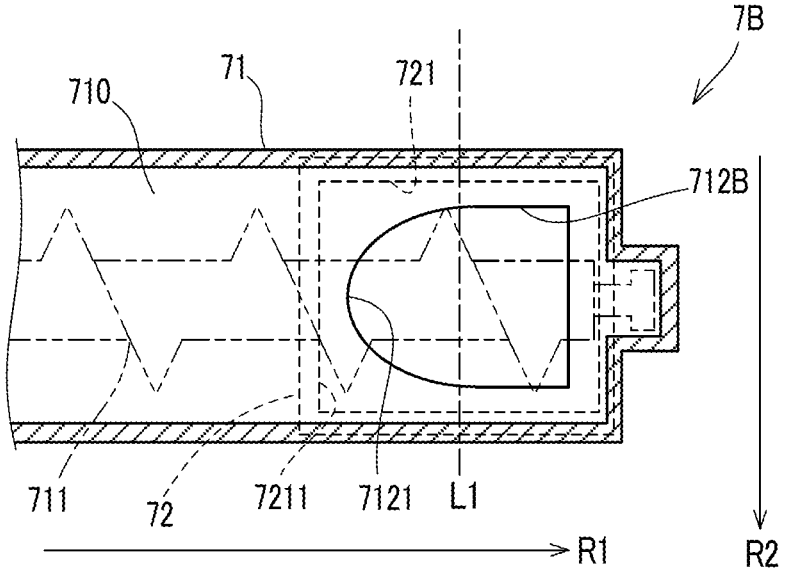
FIG. 8 is a cross-sectional plan view of the first lateral conveyance path forming portion of the developer conveying mechanism provided in the image forming apparatus according to the third embodiment of the present disclosure.

Next, a description is given of a developer conveying mechanism 7A provided in an image forming apparatus according to the second embodiment of the present disclosure, and a developer conveying mechanism 7B provided in an image forming apparatus according to the third embodiment of the present disclosure, with reference to FIGS. 7 and 8.

The following describes the differences of the developer conveying mechanism 7A and the developer conveying mechanism 7B from the developer conveying mechanism 7. The developer conveying mechanism 7A and the developer conveying mechanism 7B differ from the developer conveying mechanism 7 in the shape of the lower opening provided in the first lateral conveyance path forming portion 71.

FIG. 7 is a plan cross-sectional view of the first lateral conveyance path forming portion 71 in the developer conveying mechanism 7A. FIG. 8 is a plan cross-sectional view of the first lateral conveyance path forming portion 71 in the developer conveying mechanism 7B. In FIGS. 7 and 8, the same components as those shown in FIGS. 1-6 are assigned the same reference signs. It is noted that in FIGS. 7 and 8, the first lateral conveyance path forming portion 71 is drawn by an imaginary line.

A lower opening 712A as an outlet from which the developer 90 falls down, is formed in the vicinity of an end of the first lateral conveyance path forming portion 71 of the developer conveying mechanism 7A in the downstream side in the first lateral direction R1.

Similarly, a lower opening 712B as an outlet from which the developer 90 falls down, is formed in the vicinity of an end of the first lateral conveyance path forming portion 71 of the developer conveying mechanism 7B in the downstream side in the first lateral direction R1.

As is the case with the lower opening 712, when viewed from above, the lower openings 712A and 712B are each formed inside the rim of the inlet 721 of the longitudinal passage 720. For example, the lower openings 712A and 712B and the inlet 721 have the same center in the second lateral direction R2.

As is the case with the lower opening 712, the lower openings 712A and 712B are each formed such that the width expands from the upstream side to the downstream side in the first lateral direction R1.

More specifically, the lower openings 712A and 712B are each formed such that in a first range in the upstream side in the first lateral direction R1, the width gradually expands from the upstream side to the downstream side in the first lateral direction R1, and in a remaining second range, the width is constant.

In the example shown in FIG. 7, when viewed from above, the first range in which the width of the lower opening 712A gradually expands, extends from the edge 7121 of the lower opening 712A in the upstream side in the first lateral direction R1 to the second lateral conveyance path center line L1.

On the other hand, in the example shown in FIG. 8, when viewed from above, the first range in which the width of the lower opening 712B gradually expands, extends from the edge 7121 of the lower opening 712B in the upstream side in the first lateral direction R1 to a position exceeding the second lateral conveyance path center line L1.

Furthermore, in the examples shown in FIGS. 7 and 8, when viewed from above, the lower openings 712A and 712B are each formed in a range that extends from a position that is disposed between the second lateral conveyance path center line L1 and the edge 7211 of the inlet 721 of the longitudinal passage 720 in the upstream side in the first lateral direction R1, toward the downstream side in the first lateral direction R1. It is noted that the effect produced by forming the lower openings 712A and 712B in the above-described range is described in the fourth embodiment.

In the first range of the lower opening 712A, the lower opening 712A is formed such that its width gradually expands from the edge 7121 in the upstream side in the first lateral direction R1 along a pair of straight lines. On the other hand, in the first range of the lower opening 712B, the lower opening 712B is formed such that its width gradually expands from the edge 7121 in the upstream side in the first lateral direction R1 along a pair of curved lines.

The adoption of the developer conveying mechanism 7A or the developer conveying mechanism 7B produces the same effect as the adoption of the developer conveying mechanism 7.

Fourth Embodiment

Figure 9:
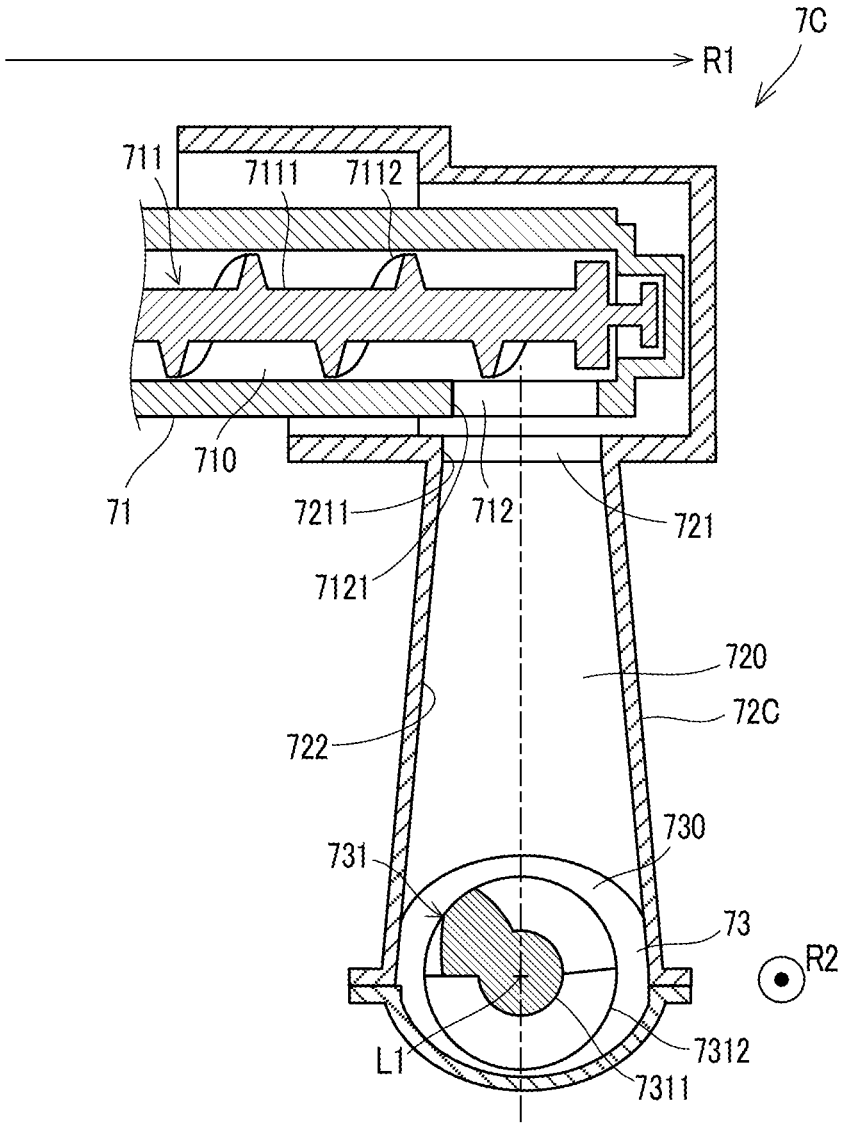
FIG. 9 is a vertical cross-sectional view of the developer conveying mechanism provided in the image forming apparatus according to the fourth embodiment of the present disclosure.

Next, a description is given of a developer conveying mechanism 7C provided in an image forming apparatus according to the fourth embodiment of the present disclosure with reference to FIG. 9. In FIG. 9, the same components as those shown in FIGS. 1-8 are assigned the same reference signs.

The following describes the differences between the developer conveying mechanism 7C and the developer conveying mechanism 7. The developer conveying mechanism 7C differs from the developer conveying mechanism 7 in the shape of the longitudinal passage forming portion.

FIG. 9 is a vertical cross-sectional view of the developer conveying mechanism 7C.

A longitudinal passage forming portion 72C of the developer conveying mechanism 7C is a portion that forms the longitudinal passage 720 of the developer 90 that has fallen down from the lower opening 712. The longitudinal passage 720 formed by the longitudinal passage forming portion 72C spreads from above to below. That is, the inner wall surface 722 of the longitudinal passage forming portion 72C is formed to spread from above to below.

With the adoption of the developer conveying mechanism 7C, it becomes possible to prevent the developer 90 from sticking to the inner wall surface 722 of the longitudinal passage 720 in a more reliable manner.

Fifth Embodiment

Figure 10:
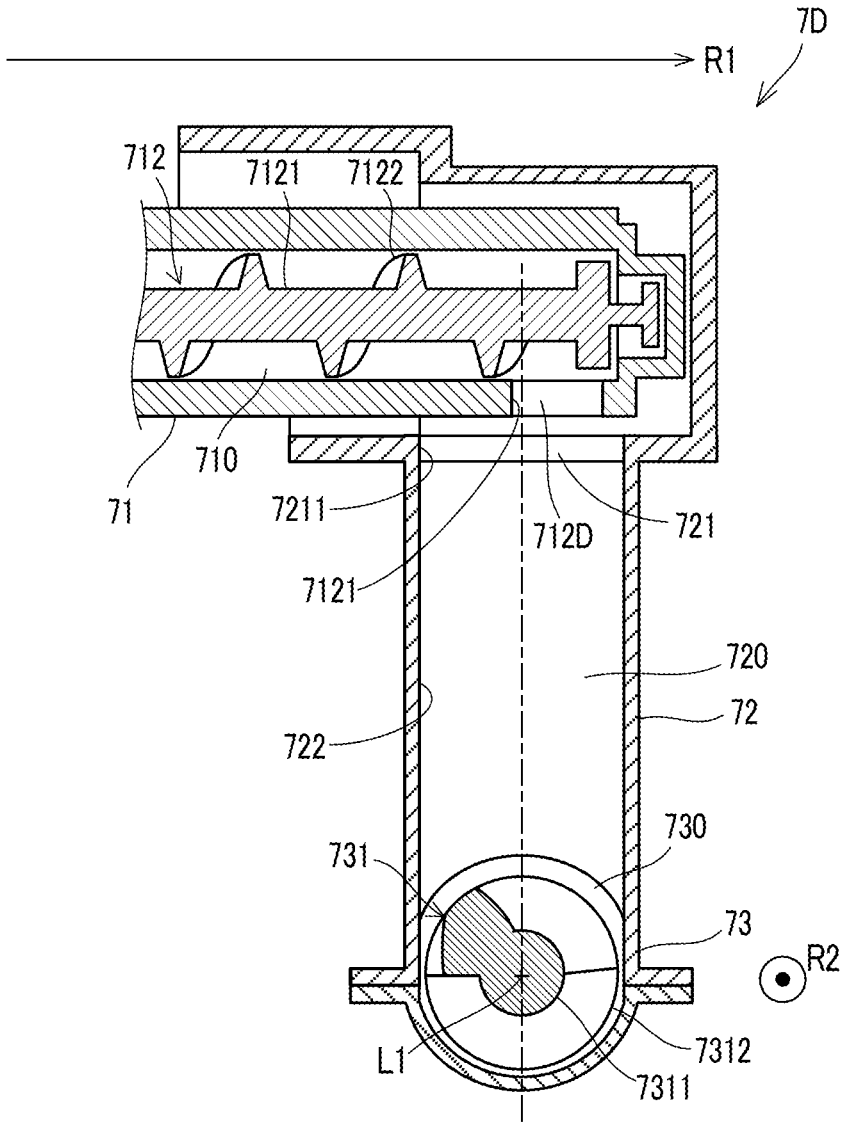
FIG. 10 is a vertical cross-sectional view of the developer conveying mechanism provided in the image forming apparatus according to the fifth embodiment of the present disclosure.
Figure 11:
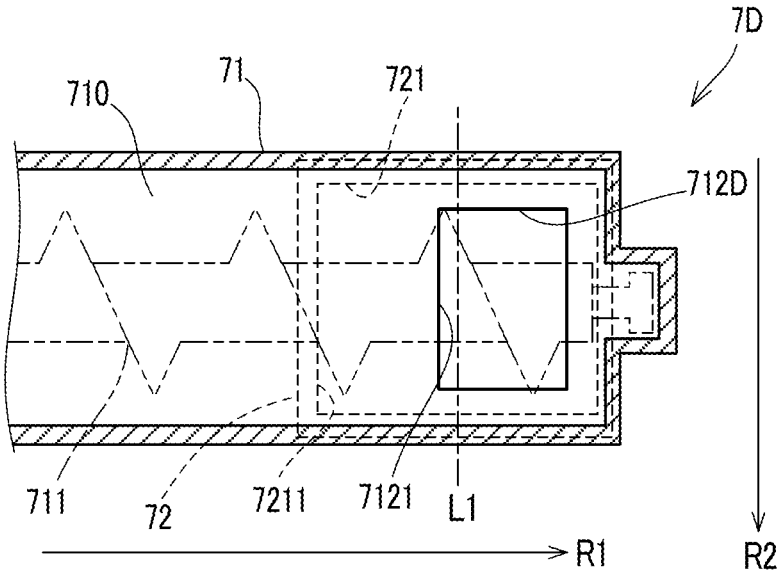
FIG. 11 is a cross-sectional plan view of the first lateral conveyance path forming portion of the developer conveying mechanism provided in the image forming apparatus according to the fifth embodiment of the present disclosure.
Figure 12:
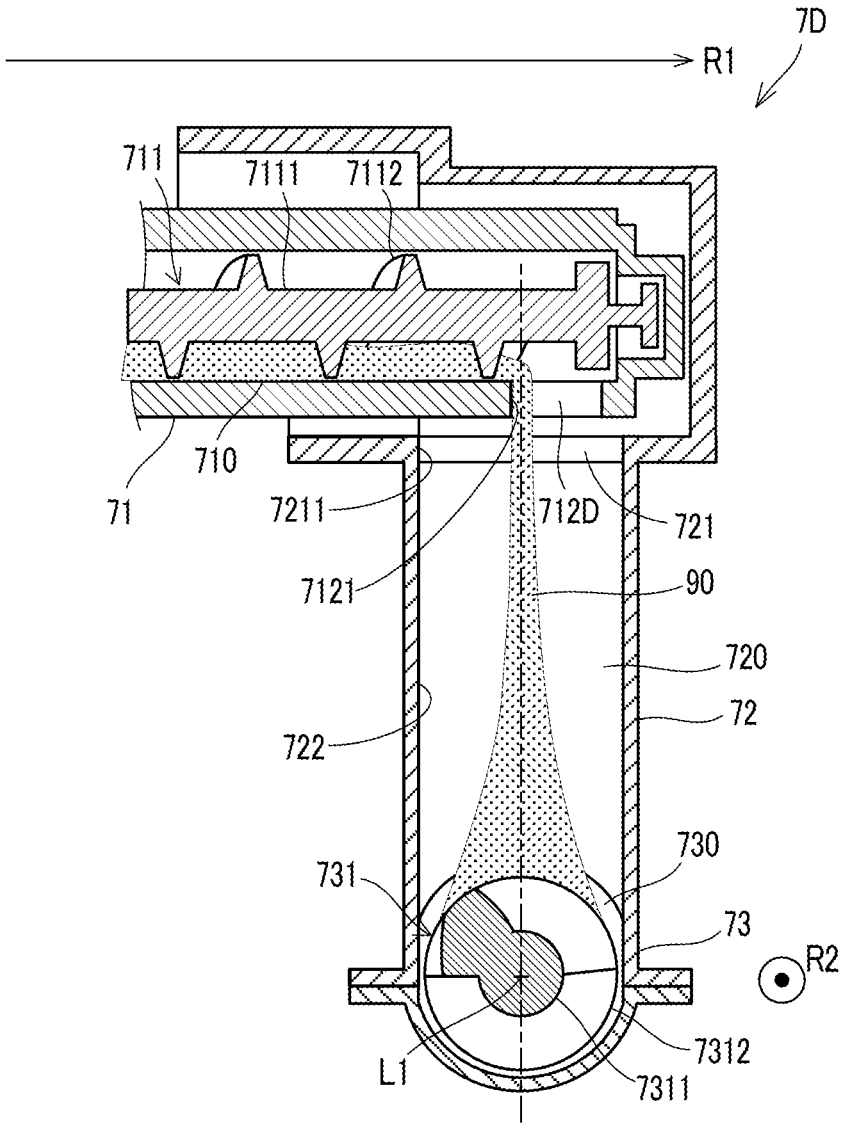
FIG. 12 is a vertical cross-sectional view of the developer conveying mechanism that is conveying the developer in the image forming apparatus according to the fifth embodiment of the present disclosure.

Next, a description is given of a developer conveying mechanism 7D provided in an image forming apparatus according to the fifth embodiment of the present disclosure with reference to FIGS. 10-12.

The following describes the differences between the developer conveying mechanism 7D and the developer conveying mechanism 7. The developer conveying mechanism 7D differs from the developer conveying mechanism 7 in the position and shape of the lower opening.

FIG. 10 is a vertical cross-sectional view of the developer conveying mechanism 7D. FIG. 11 is a plan cross-sectional view of the first lateral conveyance path forming portion 71 in the developer conveying mechanism 7D. FIG. 12 is a vertical cross-sectional view of the developer conveying mechanism 7D that is conveying the developer 90. In FIGS. 10-12, the same components as those shown in FIGS. 1-9 are assigned the same reference signs. It is noted that in FIG. 11, the first conveyance members 711 is drawn by an imaginary line.

In the vicinity of an end of the first lateral conveyance path forming portion 71 of the developer conveying mechanism 7D in the downstream side in the first lateral direction R1, a lower opening 712D as an outlet from which the developer 90 falls down, is formed.

As is the case with the lower opening 712, when viewed from above, the lower opening 712D is formed inside the rim of the inlet 721 of the longitudinal passage 720. For example, the lower opening 712D and the inlet 721 may have the same center in the second lateral direction R2.

The lower opening 712D is formed in a range that extends, when viewed from above, from a predetermined position toward the downstream side in the first lateral direction R1. The predetermined position (the position of the edge 7121) is a position that is disposed between the second lateral conveyance path center line L1 and the edge 7211 of the inlet 721 of the longitudinal passage 720 in the upstream side in the first lateral direction R1.

For example, the lower opening 712D is formed in a range that extends, when viewed from above, from a position that overlaps with the rotation shaft portion 7311 of the second conveyance member 731, toward the downstream side in the first lateral direction R1.

It is noted that the lower opening 712D is not necessarily be formed such that its width expands from the upstream side to the downstream side in the first lateral direction R1. In the example shown in FIG. 11, the lower opening 712D is formed such that its width is constant from the upstream side to the downstream side in the first lateral direction R1.

As shown in FIG. 12, the developer 90 discharged from the lower opening 712D falls from a position that is, when viewed from above, disposed away from the inner wall surface 722 of the longitudinal passage 720 toward the second lateral conveyance path center line L1. As a result, the developer 90 is difficult to stick to the inner wall surface 722 of the longitudinal passage 720.

Furthermore, the developer 90 falls onto the rotation shaft portion 7311 of the second conveyance member 731 and its peripheral. As a result, the configuration restricts the degradation of the efficiency of conveyance of the developer 90 due to the intensive accumulation of the developer 90 on the peripheral of the outer edge of the second conveyance member 731.

In the case where the developer 90 falls down from the first lateral conveyance paths 710 at an upper position to the second lateral conveyance path 730 at a lower position which both extend in the lateral direction, it is suitable to adopt the developer conveying mechanism 7D and an image forming apparatus including the developer conveying mechanism 7D. This makes it possible to prevent a conveyance failure of the developer 90 from occurring.

Application Examples

In the developer conveying mechanisms 7, 7A, 7B, and 7D, the inner wall surface of the longitudinal passage 720 may be formed in the shape of a cylinder, an elliptic cylinder, or a rectangular cylinder. In addition, in the developer conveying mechanism 7C, the inner wall surface of the longitudinal passage forming portion 72 may be formed in the shape of a remaining part of a cone, an elliptic cone, or a rectangular cone except for a part including the apex.

The developer conveying mechanisms 7, 7A, 7B, 7C, and 7D may each be a mechanism that conveys, to the developing portion 43, the developer supplied from the developer supply portions 40. For example, the first lateral conveyance path 710 may be a conveyance path of the developer supplied from the developer supply portions 40. Furthermore, the second lateral conveyance path 730 may be a conveyance path that extends from a lower position below the longitudinal passage 720 to an upper position above the developer inlet of the developing portion 43.

In addition, an edge of the lower opening 712, 712A, 712B, 712D in the downstream side in the first lateral direction R1 may be positioned more in the downstream side in the first lateral direction R1 than an edge of the inlet 721 of the longitudinal passage 720 in the downstream side in the first lateral direction R1.

It is noted that the developer conveying mechanism and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developer conveying mechanism comprising:

a first lateral conveyance path forming portion forming a first lateral conveyance path for conveying developer in a first lateral direction, a lower opening being formed on the first lateral conveyance path forming portion as an outlet from which the developer falls down;

a longitudinal passage forming portion forming a longitudinal passage of the developer that has fallen down from the lower opening; and a second lateral conveyance path forming portion forming a second lateral conveyance path for conveying the developer in a second lateral direction, wherein the first lateral conveyance path forming portion includes, inside thereof, a first conveyance member that is configured to convey the developer in the first lateral direction, the second lateral conveyance path forming portion includes, inside thereof, a second conveyance member that is configured to convey, in the second lateral direction, the developer that has passed through the longitudinal passage, the lower opening of the first lateral conveyance path forming portion is formed such that in a partial range on an upstream side in the first lateral direction, a width of the lower opening in the partial range gradually expands from the upstream side to a downstream side in the first lateral direction, and the lower opening of the first lateral conveyance path forming portion is further formed such that in a remaining range outside of the partial range, a width of the lower opening in the remaining range is constant.

2. The developer conveying mechanism according to claim 1, wherein the longitudinal passage is formed to spread from above to below.

3. The developer conveying mechanism according to claim 1, wherein when viewed from above, the lower opening is formed inside a rim of an inlet of the longitudinal passage.

4. The developer conveying mechanism according to claim 1, wherein when viewed from above, the lower opening of the first lateral conveyance path forming portion is formed in a range that extends from a predetermined position toward the downstream side in the first lateral direction, and the predetermined position is a position that is, when viewed from above, disposed between a center line of the second lateral conveyance path that extends along the second lateral direction, and an edge of an inlet of the longitudinal passage, the edge being in the upstream side in the first lateral direction.

5. The developer conveying mechanism according to claim 1, wherein when viewed from above, the lower opening of the first lateral conveyance path forming portion is formed such that at least in a predetermined range, the width thereof gradually expands from the upstream side to the downstream side in the first lateral direction, and when viewed from above, the predetermined range extends from an edge of the lower opening in the upstream side in the first lateral direction to a center line of the second lateral conveyance path that extends along the second lateral direction.

6. The developer conveying mechanism according to claim 1, wherein the first lateral conveyance path and the second lateral conveyance path are conveyance paths of waste developer that has been removed from a surface of an image carrier by a cleaning portion that cleans the surface of the image carrier.

7. An image forming apparatus comprising the developer conveying mechanism according to claim 1.

* * * * *